US005367502A

United States Patent [19]

Barroso et al.

[11] Patent Number: 5,367,502

[45] Date of Patent: Nov. 22, 1994

[54] TIMEPIECE INCLUDING A BROADCASTING ANTENNA FOR AN ELECTROMAGNETIC SIGNAL

[75] Inventors: Lucas Barroso; Pierre-André Farine, both of Neuchâtel; Minh-Tam Diep, Hauterive, all of Switzerland

[73] Assignee: Asulab S.A., Bienne, Switzerland

[21] Appl. No.: 171,638

[22] Filed: Dec. 22, 1993

[30] Foreign Application Priority Data

Dec. 23, 1992 [CH] Switzerland ..... 03 934/92-1

[51] Int. Cl.[5] ..... G04B 47/00; G04B 37/00

[52] U.S. Cl. ..... 368/10; 368/88

[58] Field of Search ..... 368/10, 47, 88, 276, 368/278, 280, 316, 318

[56] References Cited

U.S. PATENT DOCUMENTS

| | | | |
|---|---|---|---|
| Re. 32,369 | 3/1987 | Stockton et al. . | |
| 4,232,512 | 11/1980 | Yoshikawa et al. | 368/82 |
| 4,255,804 | 3/1981 | Suganuma | 368/84 |
| 4,442,590 | 4/1984 | Stockton et al. . | |
| 4,490,721 | 12/1984 | Stockton et al. . | |
| 4,847,818 | 7/1989 | Olsen | 368/10 |
| 4,884,252 | 11/1989 | Teodoridis et al. . | |
| 4,903,254 | 2/1990 | Haas | 368/327 |
| 5,179,733 | 7/1993 | Matsui | 368/282 |

FOREIGN PATENT DOCUMENTS

| | | |
|---|---|---|
| 0190412 | 8/1986 | European Pat. Off. . |
| 0312792 | 4/1989 | European Pat. Off. . |
| 0339482 | 11/1989 | European Pat. Off. . |
| 3234601 | 3/1984 | Germany . |

OTHER PUBLICATIONS

JP-A-54 073 074, Patent Abstracts of Japan, vol. 3, No. 94 (E-129), Aug. 10, 1979.

JP-A-56 169 401, Patent Abstracts of Japan, vol. 6, No. 55 (E-101) (933), Apr. 10, 1982.

*Primary Examiner*—Vit W. Miska

*Attorney, Agent, or Firm*—Pollock, Vande Sande & Priddy

[57] ABSTRACT

A timepiece which includes a case (2), a horometric movement (4) housed within the case (2) and means for broadcasting an electromagnetic signal including electronic means (12) for furnishing the signal and at least one broadcasting antenna (14) coupled to the electronic means (12). Such timepiece is characterized in that the antenna (14) is arranged on a first face (20*a*) of a support plate (20) of basically planar form arranged in the interior of the case (2), such antenna (14) being constituted by a thin metallic layer deposited on the face (20*a*) of the support plate (20). This timepiece is applicable to the control of an arrangement, for example for latching and unlatching, of a door in particular.

20 Claims, 2 Drawing Sheets

TIMEPIECE INCLUDING A BROADCASTING ANTENNA FOR AN ELECTROMAGNETIC SIGNAL

The present invention concerns a timepiece including a broadcasting antenna for an electromagnetic signal.

BACKGROUND OF THE INVENTION

Timepieces of this type which are made up in the form of a wristwatch are generally intended for the remote control of an arrangement such, for example, as illumination means or again latching and unlatching means, in particular for the door of a dwelling or an automotive vehicle. To this end the arrangement to be controlled is provided with a receiving station for the signal broadcast by the wearer of the timepiece. This receiving station processes the received signal, here in binary form, and controls the elements which are basically either electrical or electromechanical, such as a contact or a transducer in order to assure the triggering or actuation of a lamp or of a latch bolt.

Known timepieces including this type of broadcasting antenna are generally voluminous and sensitive to internal or external influences. Internal disturbances are caused by electromagnetic interactions between the antenna and the horometric movement which is housed in the timepiece, while external disturbances originate from a spurious capacitance created by the approach of the free hand of the wearer to the timepiece during transmission of the signal which is obtained by pressure on the stem.

Thus, the present invention has as purpose to overcome this drawback in providing a timepiece including a broadcasting antenna for an electromagnetic signal which is of the smallest possible volume and which is insensitive to all internal or external influence.

SUMMARY OF THE INVENTION

To this end, the present invention has as objective a timepiece of the type including a case, a horometric movement housed in the interior of said case and means for broadcasting an electromagnetic signal including electronic means for furnishing the signal and at least one broadcasting antenna coupled to said electronic means, characterized in that said antenna is arranged on a first face of a support plate of basically planar form arranged in the interior of said case, said antenna being constituted by a thin metallic layer deposited on said face of the support plate.

According to another characteristic, the electronic means for furnishing the signal are also mounted on said support plate.

It will also be specified that the electronic means for furnishing the signal are arranged on the face of the support plate on which the antenna is arranged.

In accordance with a specific embodiment of the invention, the antenna is obtained by photolithographic engraving of an electrically conductive layer deposited on said face of the support plate.

But other characteristics and advantages of the present invention will appear more clearly upon reading of the detailed description which follows and the drawings pertaining thereto, here given solely by way of example.

DESCRIPTION OF THE PREFERRED EMBODIMENT

Figure 1:
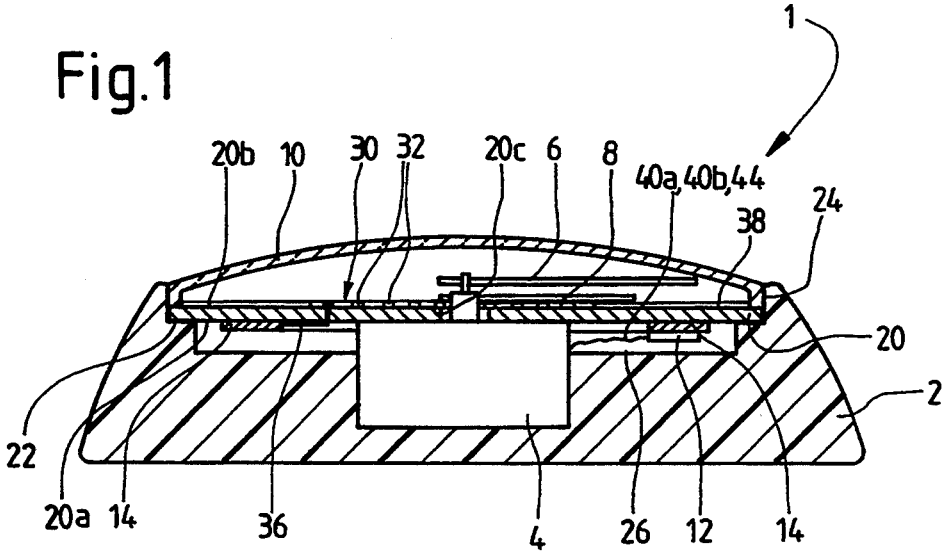
FIG. 1 is a cross-section view representing in a very schematic manner a timepiece according to the invention.
Figure 2:
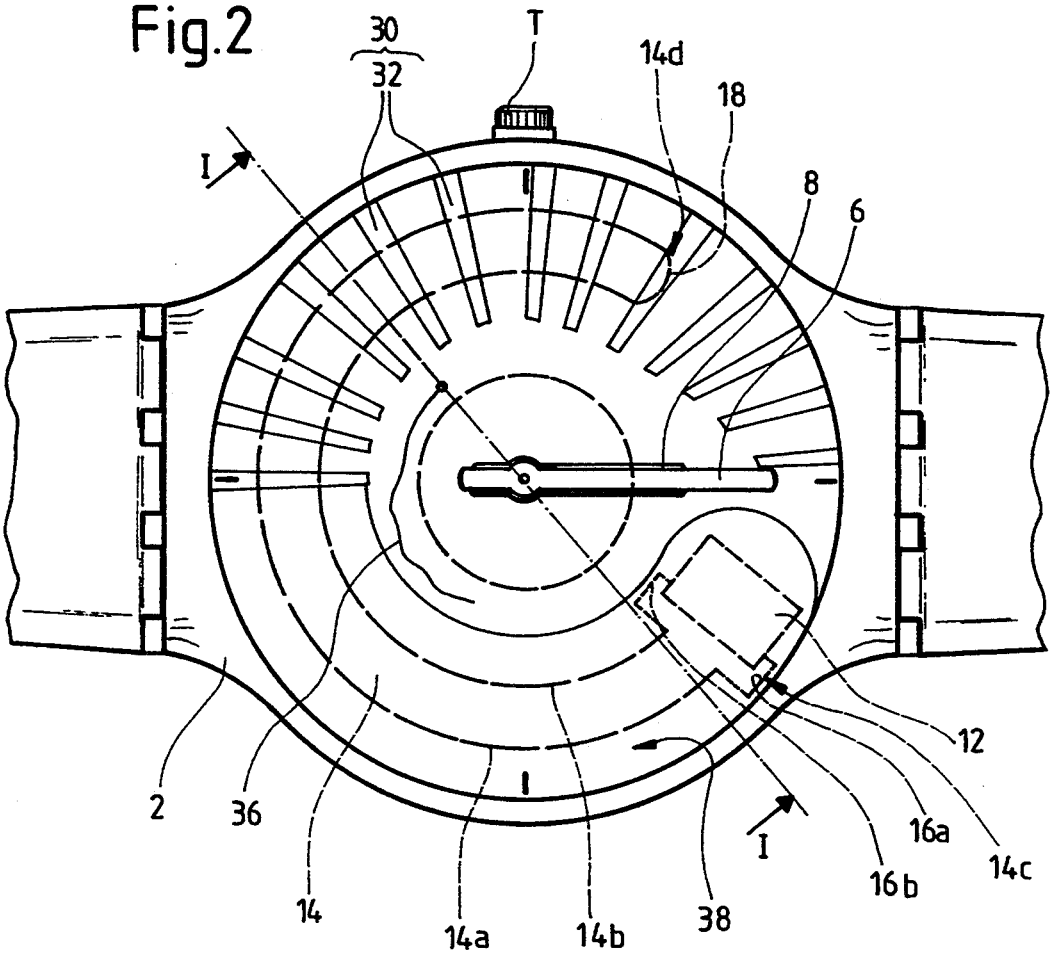
FIG. 2 is a view from above of the timepiece of FIG. 1.

Referring to FIGS. 1 and 2, there will be described hereinafter a timepiece according to the invention, here shown by the general reference 1.

Timepiece 1 includes, in a known manner, a case 2 formed for example from a plastic material by a known injection technique.

Timepiece 1 furthermore includes a horometric movement 4 which is housed in the interior of case 2 and which is here mechanically coupled to indicators 6 and 8, respectively formed by a minutes hand and by an hours hand.

Timepiece 1 is sealed by the arrangement of a crystal 10 fixedly mounted onto case 2 in a known manner, for example by a gluing or ultrasonic welding technique. Timepiece 1 is furthermore provided with means for broadcasting an electromagnetic signal, such means including electronic means for furnishing a signal referenced 12 and at least one broadcasting antenna 14 coupled to the electronic means 12.

Electronic means 12 for furnishing the signal are shown in a more detailed manner on FIG. 3 and will be described subsequently.

As is seen more specifically on FIG. 2 in broken outline, antenna 14 is constituted by two branches **14*a* and 14*b*, each exhibiting a partially circular form, such branches 14*a* and 14*b* being respectively coupled at one of their ends referenced 14*c* to electrical connection tracks 16*a* and 16*b*. Such branches 14*a* and 14*b* are otherwise coupled to one another at their other end referenced 14*d*, by a loop 18**.

Referring henceforth to FIG. 1, it will be determined that antenna 14 is arranged, here directly, on a first face **20*a* of a support plate 20 of basically planar form arranged in the interior of case 2 and clamped in the latter, on the one hand, against a shoulder 22 formed directly in case 2 and on the other hand by the free end, not referenced, of crystal 10**.

The support plate 20, which is formed of an insulating material such as epoxy, shows an outer contour which corresponds substantially to that formed by the upper cavity 24 formed in case 2 for the arrangement of the hands, respectively hours hand 8 and minutes hand 6 and for the embedding of crystal 10.

In this example the support plate 20 thus exhibits a circular contour and it is pierced in its center by an orifice **20*c* enabling passage of the pipes, not referenced, for hands 6 and 8. The support plate 20**, which has the form of a thin pellet (of a thickness of about 0.35 mm), is of a form similar to a dial, and it is adapted to be arranged in the case instead of the latter, as shown in the present embodiment or under the latter (not shown).

Antenna 14 is formed by a thin metallic layer deposited on face **20*a* of the support plate 20. As is seen on FIG. 1 in a schematic manner, the electronic means 12 for furnishing the signal are also mounted on the support plate 20 and are anchored on the face 20***a* of such plate.

Thus, in this embodiment, the electronic means 12 for furnishing the signal are arranged on the face of the support plate 20 on which is arranged antenna 14. In another embodiment, not shown, such electronic means 12 are integrated into the movement 4.

It will here be specified that antenna 14 is obtained by photolithographic engraving of an electrically conductive layer, such as a layer of copper covered by a gold deposition, such layer being deposited on face 20*a* of the support plate 20. Such engraving techniques, also referred to as structuring of thin films or layers of little thickness (less than a millimeter) deposited on a substrate, such as plate 20, are known in themselves and will not be here described in a more detailed manner.

It will also be specified that the electrical connection tracks 16*a* and 16*b* are formed on the support plate 20 in the same layer as that forming antenna 14, thus in a like thickness. Such electrical connection tracks 16*a* and 16*b* assure electrical coupling between antenna 14 and the electronic means 12 for furnishing the signal.

As is very clearly seen on FIGS. 1 and 2, the support plate 20 is, in this embodiment, arranged directly over movement 4.

More specifically, antenna 14 extends in a curved manner along the periphery of the support plate 20 and in particular along the periphery of cavity 24 of case 2 at the exterior of the movement 4.

In this example, face 20*a* of the support plate 20 is oriented facing movement 4. More specifically, such support plate 20 here acts directly as dial.

Thus, it is determined that antenna 14 as well as the electronic means 12 for furnishing the signal are arranged around movement 4 at the exterior and outside the latter, in an annular housing 26 provided to this end in case 2. Antenna 14 and the electronic means 12 for furnishing the signal are thus arranged outside the surface or frontal projection of movement 4 so that, in an axial direction, there exists no possible interference between movement 4 and the means 12, 14 for broadcasting the electromagnetic signal.

As is seen on FIG. 2, timepiece 1 further includes a capacitive plane 30 which is formed on a second face 20*b* of plate 20, such face 20*b* being opposite the first face 20*a* on which antenna 14 is arranged.

More specifically, the capacitive plane 30 is constituted by a set of striations 32 of which two only have here been referenced. Such striations 32 are arranged in a manner adjacent one another and converging in this embodiment towards the center of the support plate 20, that is to say, towards orifice 20*c* for passage of the pipes of hands 6 and 8.

It will here be specified that striations 32 forming the capacitive plane 30 are arranged on the second face 20*b* of the support plate 20 by the same technique of deposition and photolithographic structuring as antenna 14 in a thin electrically conducting film of the same type.

The capacitive plane is arranged to be normal to antenna 14 so that it covers it over almost entirely.

Following several trials, it has appeared that the capacitive plane 30 permitted an effective protection against spurious capacitance due, for example, to the approach of the free hand of the user towards the timepiece, in particular during actuation of means 12, 14 for broadcasting of the electromagnetic signal. The capacitive plane 30 being arranged on the upper visible face 20*b* of the support plate 20 forming the dial, such capacitive plane 30 furthermore constitutes patterns of an ornamental nature.

In addition, antenna 14 includes an extension which is formed by a track 36 electrically connected to the so-called lower layer forming antenna 14 and which is arranged proximate the center of the support plate 20 on the second face 20*b*, here forming the upper face. Track 36 thus traverses the support plate 20 via a metallization and an orifice, not shown, in order to come into contact with the layer forming antenna 14 on face 20*a*, here making up the lower face.

A grounding plane 38, electrically connected to movement 4, is furthermore arranged on the upper face 20*b* proximate the capacitive plane 30.

Figure 3:
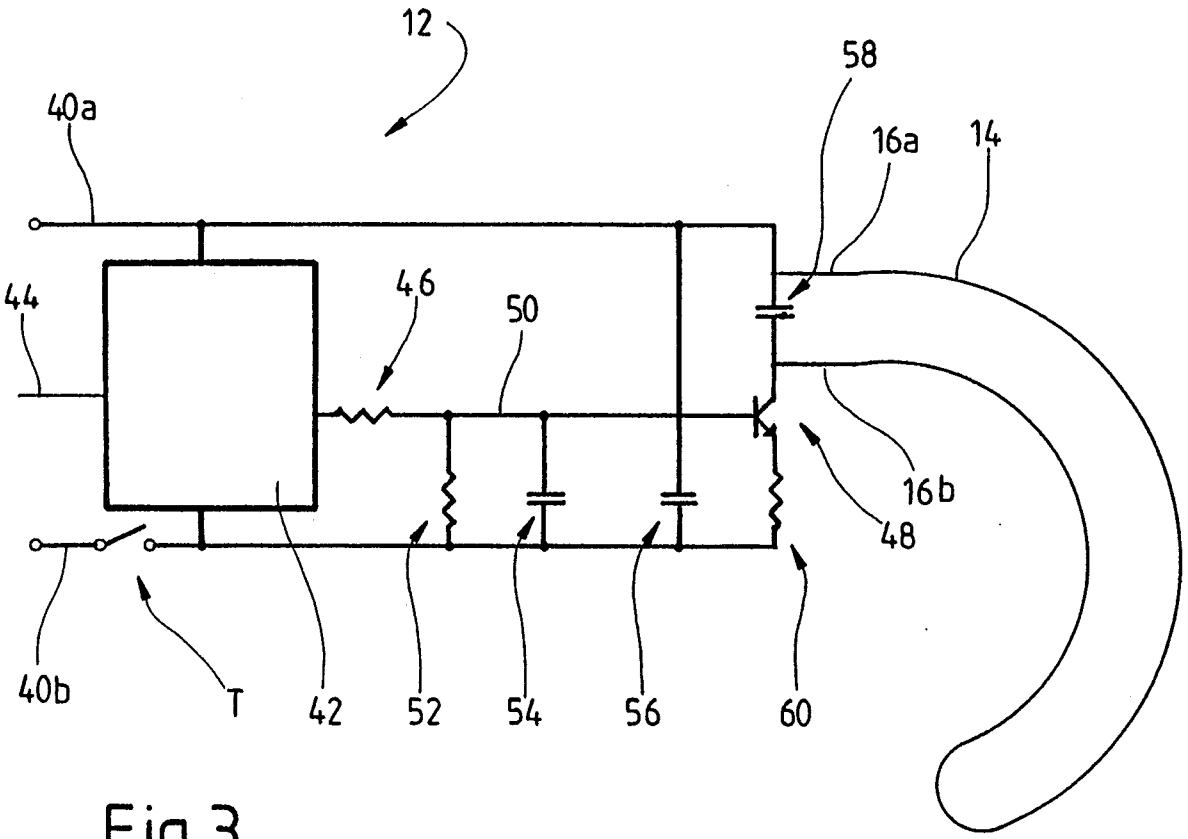
FIG. 3 shows the electronic means for furnishing a signal and which are intended to be coupled to the antenna of the timepiece of FIGS. 1 and 2.

Here it will be specified that actuation of means 12, 14 for broadcasting the electromagnetic signal, is enabled by the urging of stem T, represented in a schematic manner on FIG. 3 and in particular by a brief pressure on the latter.

Referring henceforth to such FIG. 3, there will be described hereinafter the electronic means 12 for furnishing the signal which is intended to be transmitted by antenna 14.

Circuit 12 includes two energization lines respectively 40*a* and 40*b* (here respectively positive and negative) made up by electrical connection wires coupled to an electrical source, not shown, of movement 4.

The electronic means 12 further include a logic broadcasting circuit 42 coupled between the two respective energization lines 40*a* and 40*b*.

The logic broadcasting circuit 42 receives from line 44 also connected to a time base, not shown, for the horometric movement 4, a clock signal fixed on a frequency such as for instance 32 kHz.

It is determined that the stem, in the form of a switch, is connected to the energization line 40*b* above the connection point between the logic broadcasting circuit 42 and the energization line 40*b*.

At the output of the logic broadcasting circuit 42 is connected a first resistor 46 which itself is coupled to the base of a transistor 48.

The coupling between resistor 46 and transistor 48 forms an intermediate line 50. Between such line 50 and the energization line 40*b* are respectively coupled, on the one hand, a resistor 52 and on the other hand a capacitor 54. A second capacitor, referenced 56, is for its part coupled between the two energization lines 40*a* and 40*b*.

A third capacitor 58 is coupled between the two electrical connections 16*a* and 16*b* of antenna 14. The first electrical connection 16*a* of antenna 14 is thus coupled between the first energization line 40*a* and capacitor 58 while the second connection track 16*b* is coupled between capacitor 58 and the collector of transistor 48. As to the emitter of transistor 48, this is coupled to the second energization line 40*b* via a resistor 60.

What we claim is:

1. A timepiece comprising a case, a horometric movement housed in the interior of said case and means for broadcasting an electromagnetic signal including electronic means for furnishing the signal and at least one broadcasting antenna coupled to said electronic means, said antenna being arranged on a first face of a support plate which acts as a dial of the timepiece, has a basically planar form and is arranged in the interior of said case, and said antenna comprising a thin metallic layer deposited on said first face of the support plate.

2. A timepiece as set forth in claim 1, wherein said electronic means for furnishing the signal is also mounted on the support plate.

3. A timepiece as set forth in claim 2, wherein said electronic means for furnishing the signal is arranged on said first face of the support plate on which the antenna is arranged.

4. A timepiece as set forth in claim 1, wherein said antenna is obtained by photolithic engraving of an electrically conductive layer deposited on said first face of said support plate.

5. A timepiece as set forth in claim 3, wherein said support plate includes electrical connection tracks assuring the coupling between the antenna and the electronic means for furnishing the signal.

6. A timepiece as set forth in claim 5, wherein the electrical connection tracks are structured in the same layer as that forming the antenna.

7. A timepiece as set forth in claim 1, said antenna being constituted by two branches of partially circular form, respectively coupled at one of their ends to the electrical connections and at their other end to one another through a loop.

8. A timepiece as set forth in claim 1 further comprising a capacitive plane arranged on a second face of the support plate opposite the first face supporting the antenna.

9. A timepiece as set forth in claim 8, wherein said capacitive plane is formed by a set of striations arranged adjacent one another and converging towards the center of the support plate.

10. A timepiece as set forth in claim 9, wherein said capacitive plane is formed normal to said antenna.

11. A timepiece as set forth in claim 1, wherein said support plate is arranged proximate the movement.

12. A timepiece as set forth in claim 1, wherein said support plate is arranged directly above the movement.

13. A timepiece as set forth in claim 1, wherein the antenna extends along the periphery of the support plate at the exterior of the movement.

14. A timepiece as set forth in claim 1, wherein said first face supporting the antenna is oriented facing the movement.

15. A timepiece as set forth in claim 8, wherein the capacitive plane forms patterns of an ornamental nature.

16. A timepiece comprising a case, a horometric movement housed in the interior of said case and means for broadcasting an electromagnetic signal including electronic means for furnishing the signal and at least one broadcasting antenna coupled to said electronic means, said antenna comprising a thin metallic layer deposited on a first face of a support plate of basically planar form arranged in the interior of said case, and a capacitive plane being arranged on a second face of the support plate opposite to the first face supporting said metallic layer.

17. A timepiece as set forth in claim 16, wherein said electronic means for furnishing the signal is also mounted on the support plate.

18. A timepiece as set forth in claim 17, wherein said electronic means for furnishing the signal is arranged on said first face of the support plate.

19. A timepiece as set forth in claim 18, wherein said support plate includes electrical connection tracks for assuring the coupling between said antenna and said electronic means for furnishing the signal, said electrical connection tracks being structured in said metallic layer.

20. A timepiece as set forth in claim 16, wherein the metallic layer of said antenna is obtained by photolithic engraving of an electrically conductive layer deposited on said first face of the support plate.

* * * * *